US007197257B2

(12) United States Patent
Nishizawa et al.

(10) Patent No.: US 7,197,257 B2
(45) Date of Patent: Mar. 27, 2007

(54) MULTIFUNCTION APPARATUS

(75) Inventors: Minoru Nishizawa, Fujisawa (JP); Hideki Nakatsuka, Yokohama (JP); Akihiro Mitsuhashi, Fujisawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 261 days.

(21) Appl. No.: 11/065,372

(22) Filed: Feb. 25, 2005

(65) Prior Publication Data

US 2005/0191077 A1 Sep. 1, 2005

(30) Foreign Application Priority Data

Feb. 26, 2004 (JP) ..... 2004-051999

(51) Int. Cl.
*G03G 15/00* (2006.01)

(52) U.S. Cl. ..... 399/80; 358/401; 358/501

(58) Field of Classification Search ..... 399/75, 399/79, 80, 83; 358/400, 401, 501
See application file for complete search history.

(56) References Cited

U.S. PATENT DOCUMENTS

| | | | | |
|---|---|---|---|---|
| 6,724,494 | B1 * | 4/2004 | Danknick | 358/1.14 |
| 2001/0048823 | A1 | 12/2001 | Nomura et al. | |
| 2002/0085850 | A1 * | 7/2002 | Nakata et al. | 399/66 |
| 2002/0114024 | A1 | 8/2002 | Chiu | |
| 2003/0053111 | A1 | 3/2003 | Endo | |
| 2003/0214684 | A1 * | 11/2003 | Kuboki | 358/474 |
| 2004/0042049 | A1 * | 3/2004 | Hulan et al. | 358/404 |

FOREIGN PATENT DOCUMENTS

| | | |
|---|---|---|
| EP | 1014678 | 6/2000 |
| EP | 1093287 | 4/2001 |
| JP | 5-130378 | 5/1993 |
| JP | 8-242326 | 9/1996 |
| JP | 9-168066 | 6/1997 |
| JP | 9168066 | 6/1997 |
| JP | 10-315535 | 12/1998 |
| JP | 11-143651 | 5/1999 |
| JP | 2001-156949 | 6/2001 |
| JP | 2001-292262 | 10/2001 |
| JP | 2002-007264 | 1/2002 |
| JP | 2003-233725 | 8/2003 |
| JP | 2003-323281 | 11/2003 |

(Continued)

OTHER PUBLICATIONS

English language Abstract of JP 5-130378.

(Continued)

*Primary Examiner*—Hoan Tran
(74) *Attorney, Agent, or Firm*—Greenblum & Bernstein, P.L.C.

(57) ABSTRACT

A destination for a job completion notification that is preset by a user is stored. When the user enters a detection area, an electromagnetic wave signal is transmitted to a memory card that is carried by the user so that the user identification information is scanned. When the job is completed, the job completion notification is transmitted to the stored destination for the job completion notification. Therefore, it is possible to transmit the job completion notification to a desired address even when the user instructs a job, such as copying job or facsimile memory transmission job, by directly setting a document on a multifunction apparatus.

11 Claims, 10 Drawing Sheets

FOREIGN PATENT DOCUMENTS

WO 97/38523 10/1997

OTHER PUBLICATIONS

English language Abstract of JP 2001-156949.
English Language Abstract of JP 9-168066.
English Language Abstract of JP 2003-323281.
English Language Abstract of JP 2002-007264.
English Language Abstract of JP 2001-292262.
English Language Abstract of JP 10-315535.
English Language Abstract of JP 11-143651.
English Language Abstract of JP 2003-233725.
English Language Abstract of JP 8-242326.
U.S. Appl. No. 11/065,083 to Nishizawa et al., filed Feb. 25, 2005.
U.S. Appl. No. 11/065,076 to Nishizawa et al., filed Feb. 25, 2005.
U.S. Appl. No. 10/893,279 to Kizawa, filed Jul. 19, 2004.
U.S. Appl. No. 11/065,571 to Nishizawa et al., filed Feb. 25, 2005
U.S. Appl. No. 11/065,368 to Nishizawa et al., filed Feb. 25, 2005.
U.S. Appl. No. 11/065,373 to Nishizawa et al., filed Feb. 25, 2005.

* cited by examiner

Fig.8

800

<Display screen example of completion notification>

Status monitor-Panasonic DP 3010

801 Job ID:4014
802 Job name:1patent Warmup.doc
803 Job type:copy
804 Start time:2004/01/28 16:34:07
805 End time:2004/01/28 16:34:25
806 Number of pages:4
807 Error:0
808 Job condition:normal completion(delete spool data)

OK

MULTIFUNCTION APPARATUS

BACKGROUND OF THE INVENTION

1. Field of the Invention

The present invention relates to a multifunction apparatus that includes a plurality of functions including a copier function.

2. Description of Related Art

A multifunction apparatus having a plurality of functions such as printer, copier, scanner, facsimile, and e-mail functions has become common. When copying a large volume of paper or transmitting such a volume via facsimile using a memory on the multifunction apparatus, the user often leaves the multifunction apparatus prior to completing the copying or the memory transmission job in order to work on other projects. The user can effectively work if it is possible to find out when the job (copying, memory transmission, etc.) is completed even at a remote location (e.g., user's desk) away from the multifunction apparatus.

Conventionally, a system and a method for notifying job operation status has been introduced, the system and method enabling a host computer to accurately check operation status and completion of an image input/output apparatus (e.g., Related Art 1). When there is a job request made from the host computer, core section 10 of the image input/output apparatus (e.g., multifunction copier) generates a unique job ID for each job. When the job information at the printer or the like changes, the job information along with the job ID is transmitted to the host computer.

[Related Art 1] Japanese Patent Laid Open Application H11-143651

The conventional job completion notification method had the following shortcomings. When a client computer requests a job to a multifunction apparatus, the job completion notification can be transmitted back to the client computer. However, when the user instructs a job (copying, memory transmission, etc.) by directly setting a document on the multifunction apparatus, the job completion notification cannot be sent back to the user.

SUMMARY OF THE INVENTION

The present invention addresses the above-described problem. The purpose of the invention is to provide a multifunction apparatus that can transmit a job completion notification to a desired destination even when the user directly sets the document on the multifunction apparatus and instructs a job (copying, memory transmission, etc.).

In the present invention, a destination for a job completion notification that is preset by a user is stored. When the user enters a detection area, an electromagnetic wave signal is transmitted to a memory card that is carried by the user so that the user identification information is scanned. When the job is completed, the job completion notification is transmitted to the stored destination for the job completion notification.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein:

FIG. 7(*b*) is a second chart that illustrates personal information of another user according to the embodiment;

FIG. 7(*c*) is a third chart that illustrates personal information of another user according to the embodiment;

FIG. 8 illustrates a job completion notification according to the embodiment;

DETAILED DESCRIPTION OF PREFERRED EMBODIMENTS

Figure 1:
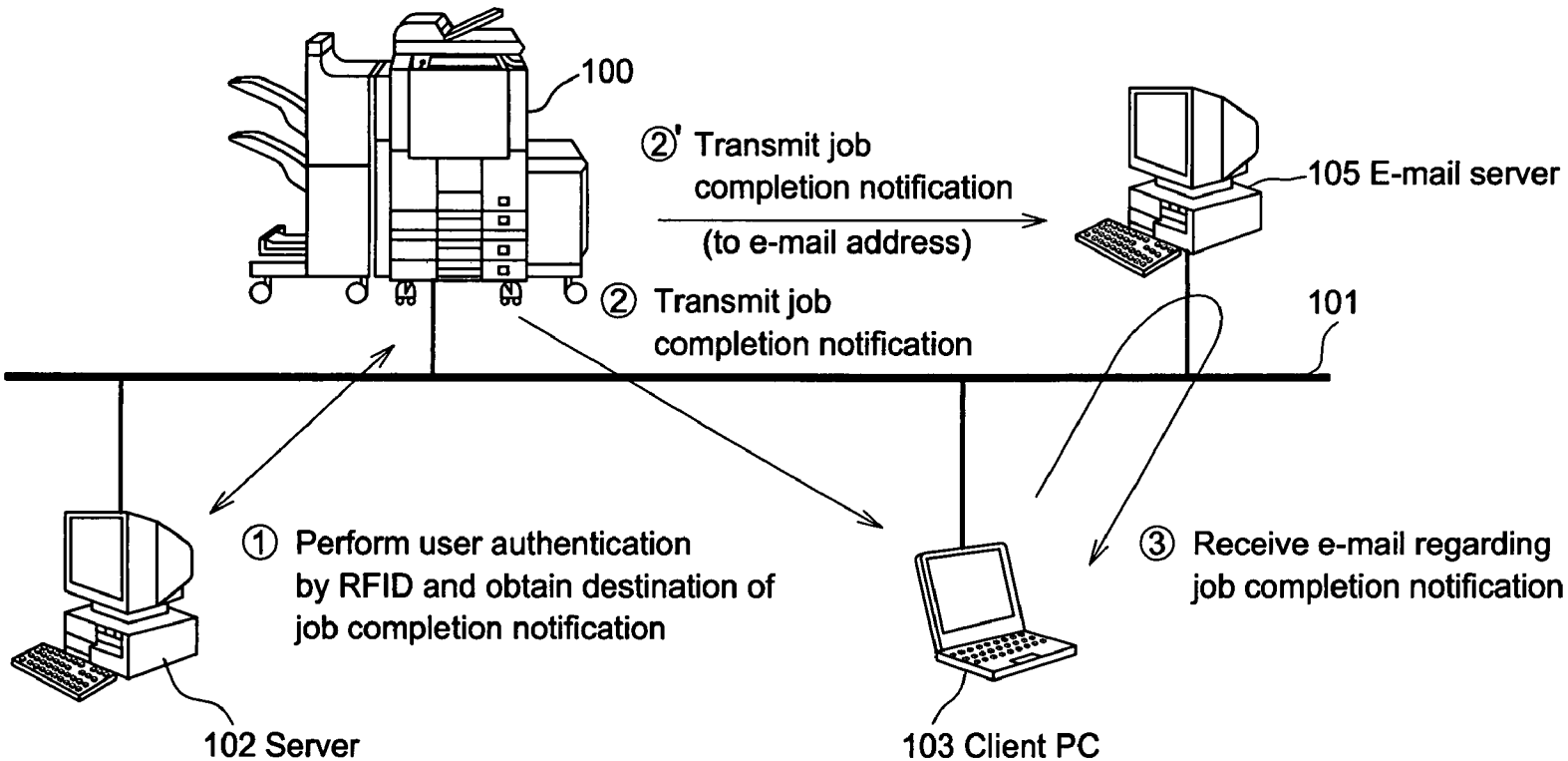
FIG. 1 illustrates a general system that includes a multifunction apparatus according to an embodiment of the present invention.

The embodiments of the present invention are explained in the following, in reference to the above-described drawings. FIG. 1 illustrates a general configuration of a system that includes a multifunction apparatus according to an embodiment of the present invention.

The system includes multifunction apparatus 100 that has printer, copier, scanner, facsimile, e-mail, and other functions; server 102 that includes a personal information server having a personal information table in order to perform personal authentication; client PC 103 that is used by a user; and e-mail server 105 that performs e-mail transmission/reception between multifunction apparatus 100 and client PC 103, all of which are connected through LAN 101.

The following illustrates a general operation of the above-described system.

First, multifunction apparatus 100 obtains personal identification information from a memory card carried by a user and performs user authentication at the personal information server (server 102). Then, multifunction apparatus 100 receives a job (e.g., copying, facsimile transmission) from the user.

Upon completing the job received from the user, multifunction apparatus 100 obtains, from the personal information server 102 the destination and method for a job completion notification that is included in the personal information of the user, and transmits the job completion notification to the obtained destination using the obtained notification method.

Accordingly, even when the user directly sets the document on multifunction apparatus 100 and instructs a job (copying, memory transmission, etc.), the job completion notification is transmitted to a desired destination of the authenticated user. As a result, the user can confirm that multifunction apparatus 100 has completed the job.

There are two methods for transmitting the job completion notification. The first method is for multifunction apparatus 100 to transmit an e-mail notification via e-mail server 105, using an e-mail address of client PC 103. The second method is for multifunction apparatus 100 to directly transmit the notification to client PC 103, using the IP address of client PC 103.

Figure 2:
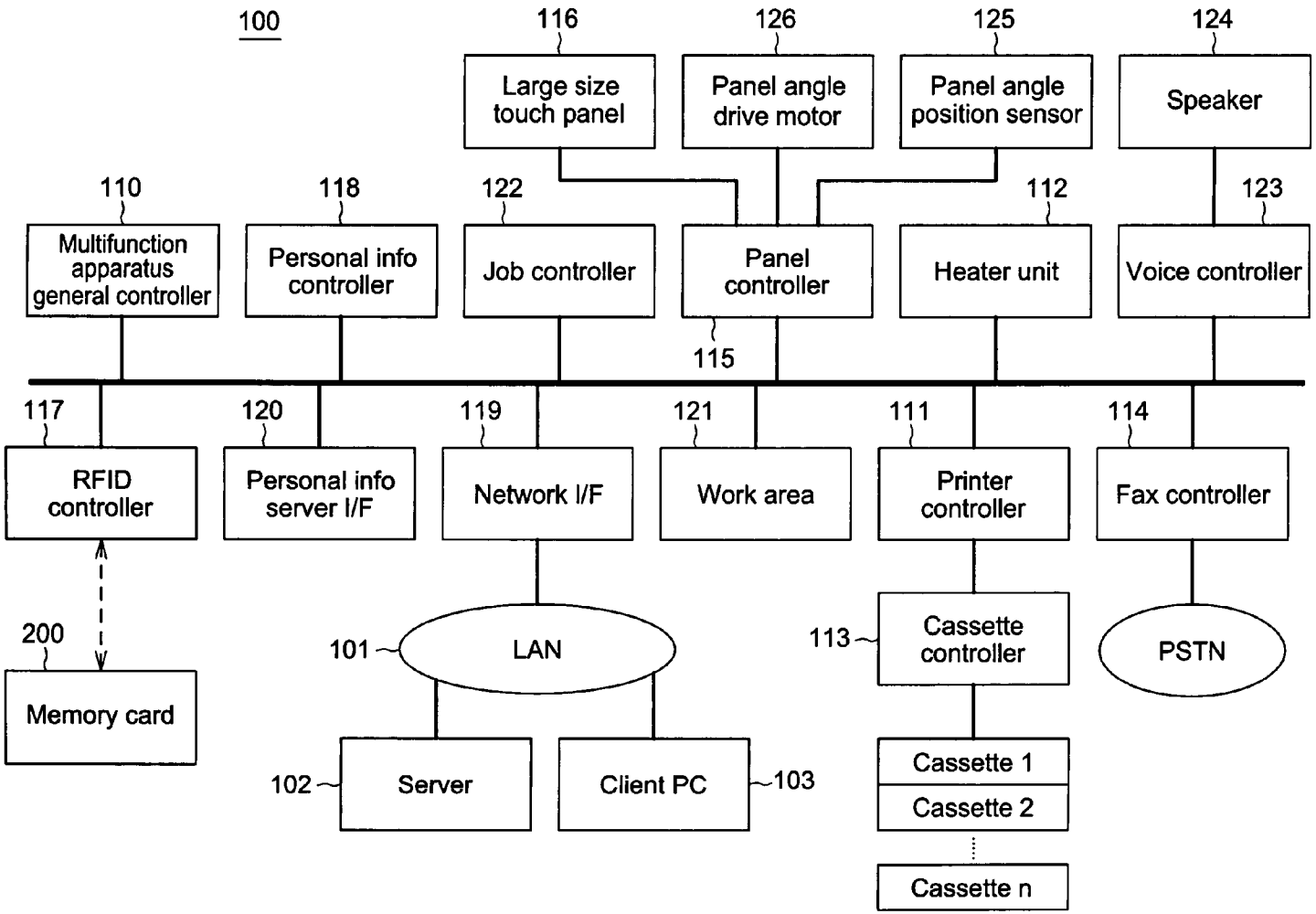
FIG. 2 is a functional block diagram illustrating the multifunction apparatus according to the embodiment.

The following describes in detail, in FIG. 2, a configuration of multifunction apparatus 100 according to the embodiment of the invention. FIG. 2 is a functional block diagram of multifunction apparatus 100 according to the embodiment of the present invention. FIG. 2 also shows a portion of the network.

Multifunction apparatus 100 can be connected to various servers 102 and client PCs 103, via LAN 101.

Server 102 can be a personal information server that stores a personal information table and performs personal authentication and personal information distribution. Server 102 can also be a web server that executes a job selected from a menu in a remote procedure method. In the following description, server 102 is illustrated as personal identification server 102.

Although multifunction apparatus 100 includes printer, copier, scanner, facsimile, and e-mail functions, FIG. 1 only shows blocks related to the printer and facsimile functions.

Multifunction apparatus general controller 110 controls the overall multifunction apparatus 100.

Printer controller 111 executes a process that converts printout data (given from a client) into image data in a predetermined format. Printer controller 111 especially gives a warm up instruction to heater unit (fusing apparatus) 112 in an image generation unit (not shown in the figure), and gives a cassette selection instruction to cassette controller 113.

Cassette controller 113 selects an indicated cassette from a plurality of vertically stacked cassettes (1)–(n), and feeds paper to the image generation unit.

Fax controller 114 has a modem that is connected to a PSTN to execute steps for a facsimile communication.

Panel controller 115 displays an operation screen and the like on large-size touch panel 116 and analyzes an operation input by the user from where the user touched on large-size touch panel 116 and from the displayed contents.

RFID controller 117 reads and writes data on memory card 200 using electromagnetic wave signals. When a magnetic field is applied to memory card 200 from RFID controller 117, the reflected electromagnetic wave includes effect (information) corresponding to the memory contents of memory card 200. RFID controller 117 detects the memory contents of memory card 200 using the reflected electromagnetic wave. Conversely, electromagnetic wave signals applied from RFID controller 117 to memory card 200 is used to write information because the signals have a magnetic influence on memory card 200. RFID controller 117 performs non-contact reading/writing of card registration data, via electromagnetic wave signals, from/into memory card 200 in the detection area approximately within a 1-meter radius range.

Personal information controller 118 manages the write-in destination of the registration data, which is read from memory card 200.

In addition, personal information controller 118 notifies RFID controller 117 of data to be written in memory card 200.

Network I/F 119 is a section that interfaces with LAN 101.

Personal information server I/F 120 executes a process for communicating with personal information server 102 among servers on LAN 101.

Work area 121 stores data received from memory card 200 and personal information server 102.

Job controller 122 provides a command to an appropriate unit when a job is executed using a function such as copier, printer, facsimile, scanner, or e-mail functions. In addition, job controller 122 transmits a job completion notification to client PC 103, upon completion of a job.

Voice controller 123 stores voice data for a voice guidance. Upon receiving a voice guidance instruction (in synchronization with the user's operation) from panel controller 115 and job controller 122, voice controller 123 outputs the corresponding voice data to speaker 124. It is preferable that the voice guidance is provided to assist the operation on the operation screen that is displayed on large-size touch panel 116. However, other types of voice guidance can be provided.

Panel angle position sensor 125 detects an angle of large-size touch panel 116. Panel angle drive motor 126 receives a control signal from panel controller 115 and adjusts the angle of large-size touch panel 116. Although in this embodiment, the angle of large-size touch panel 116 is adjustable, the angle can be at a fixed position.

Multifunction apparatus has the above-described configuration.

Figure 3:
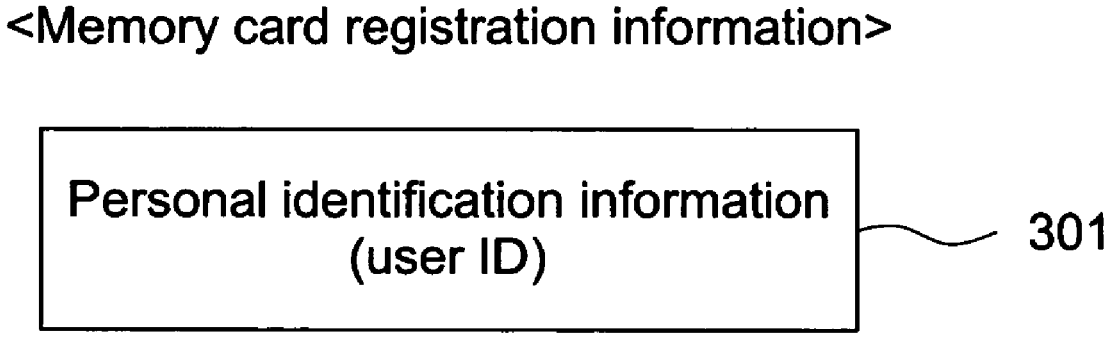
FIG. 3 illustrates registration information in a memory card according to the embodiment.

The following illustrates registration information of memory card 200, using FIG. 3. FIG. 3 illustrates the registration information of memory card 200.

As shown in the figure, memory card 200 only stores user ID 301 as personal identification information. This identification information is used for the user authentication and retrieving the user information. It is preferable to limit the registration information of memory card 200 to a user ID for security purposes.

Figure 4:
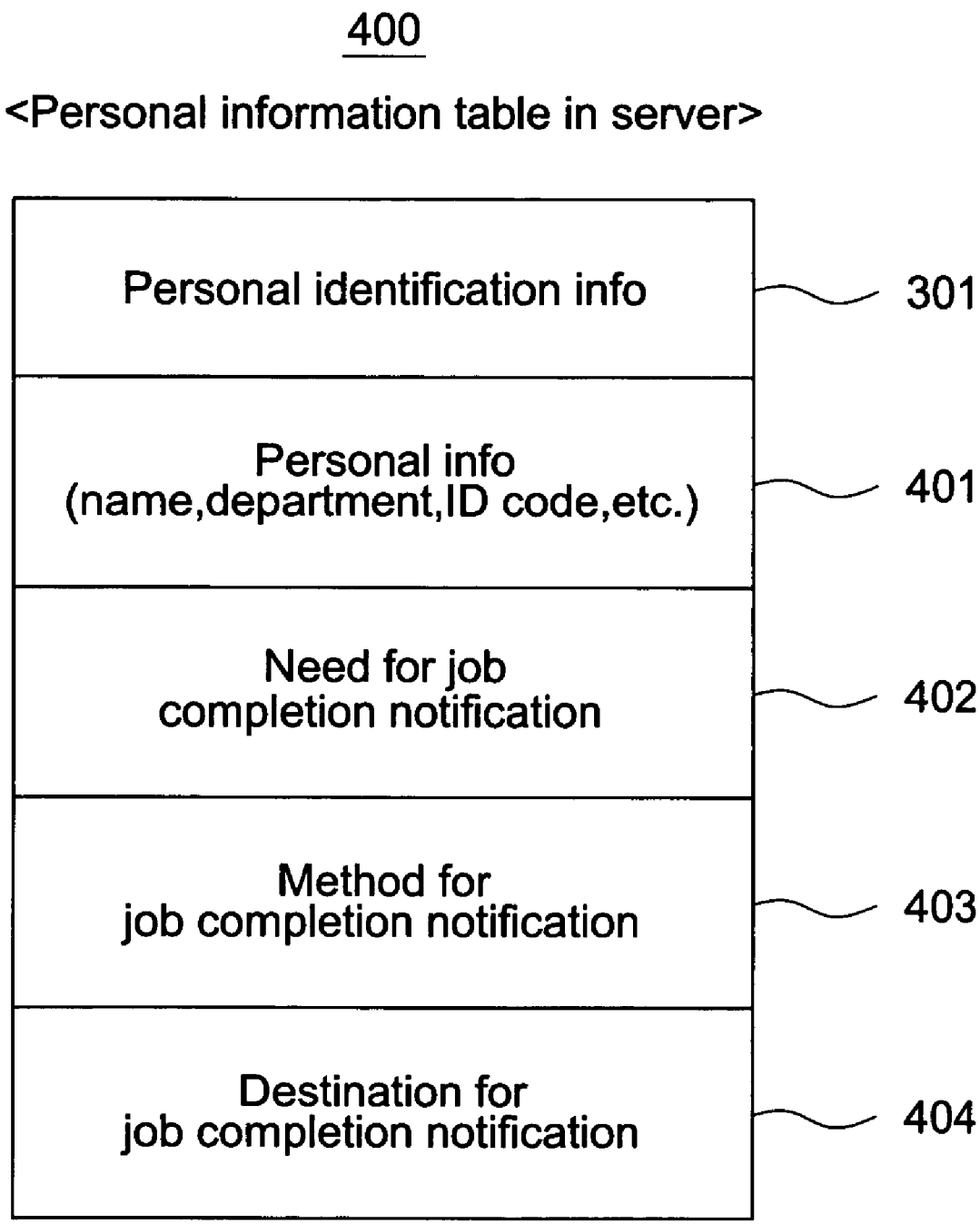
FIG. 4 illustrates a personal information table according to the embodiment.

Next, the following illustrates a configuration of the personal information table registered in personal information server 102, using FIG. 4. FIG. 4 illustrates a data structure of the personal information table registered in personal information server 102. The personal information table is generated for each registered user.

Personal information table 400 includes user ID 301 (personal identification information), personal information 401 (name, department to which the user belongs, ID code, etc.), information 402 (indicating whether job completion notification is needed), notification method 403 (for job completion notification), and destination 404 (for job completion notification).

User ID 301 is the same as the user ID shown in FIG. 2.

Although the personal information 401 is not limited to the above configuration as long as the information is related to the personal information, the personal information 401 in this embodiment includes a personal name, department to which the user belongs, ID code (not the user ID), etc.

Job completion notification method 403 includes two methods: e-mail notification method; and SNMP Trap notification method.

Destination for job completion notification 404 is an e-mail address when job completion notification method 403 is the e-mail notification method. When job completion notification method 403 is the SNMP Trap notification method, job completion notification 404 is an IP address.

Figure 5:
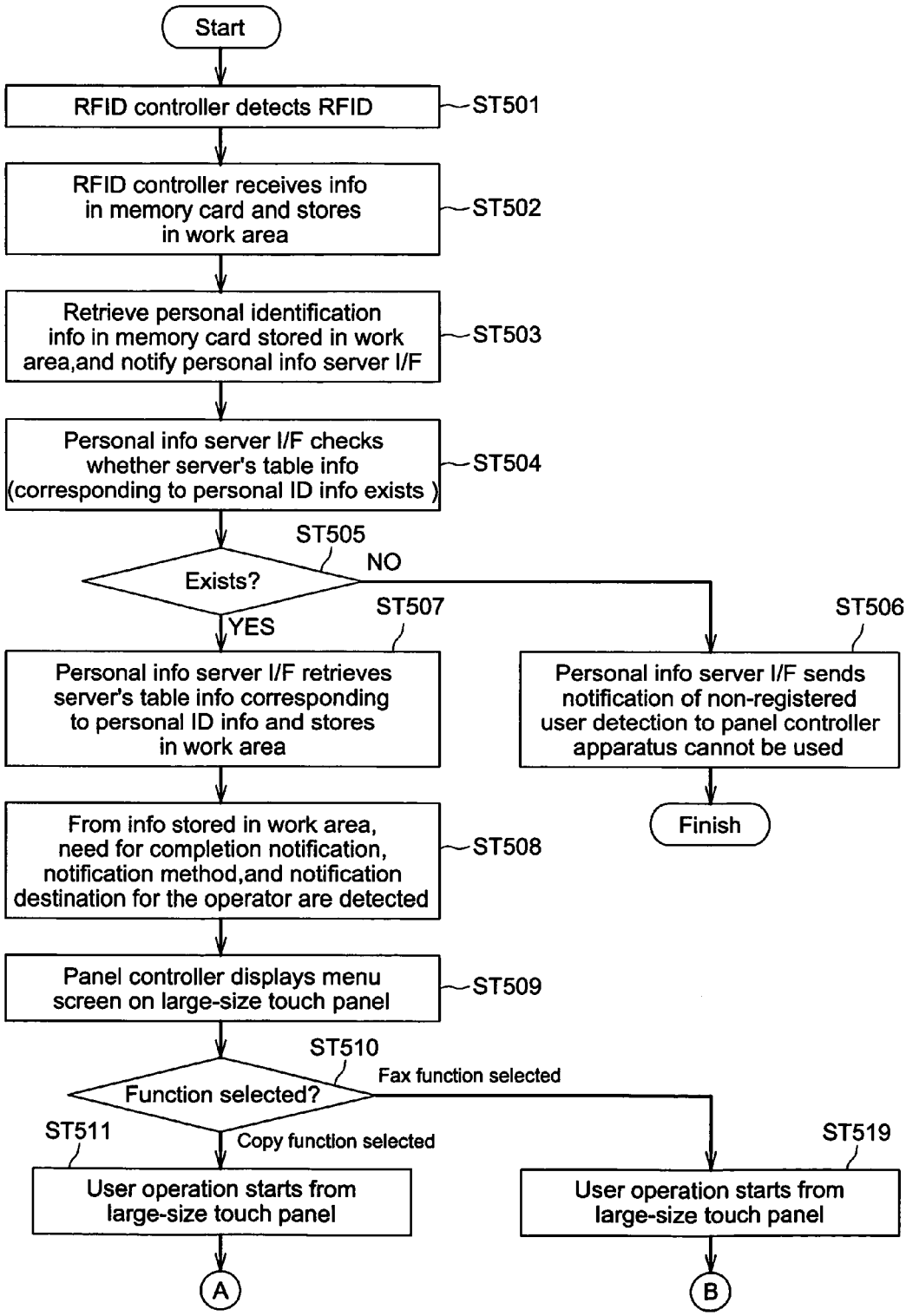
FIG. 5 is a first flowchart illustrating an operation of the multifunction apparatus according to the embodiment.
Figure 6:
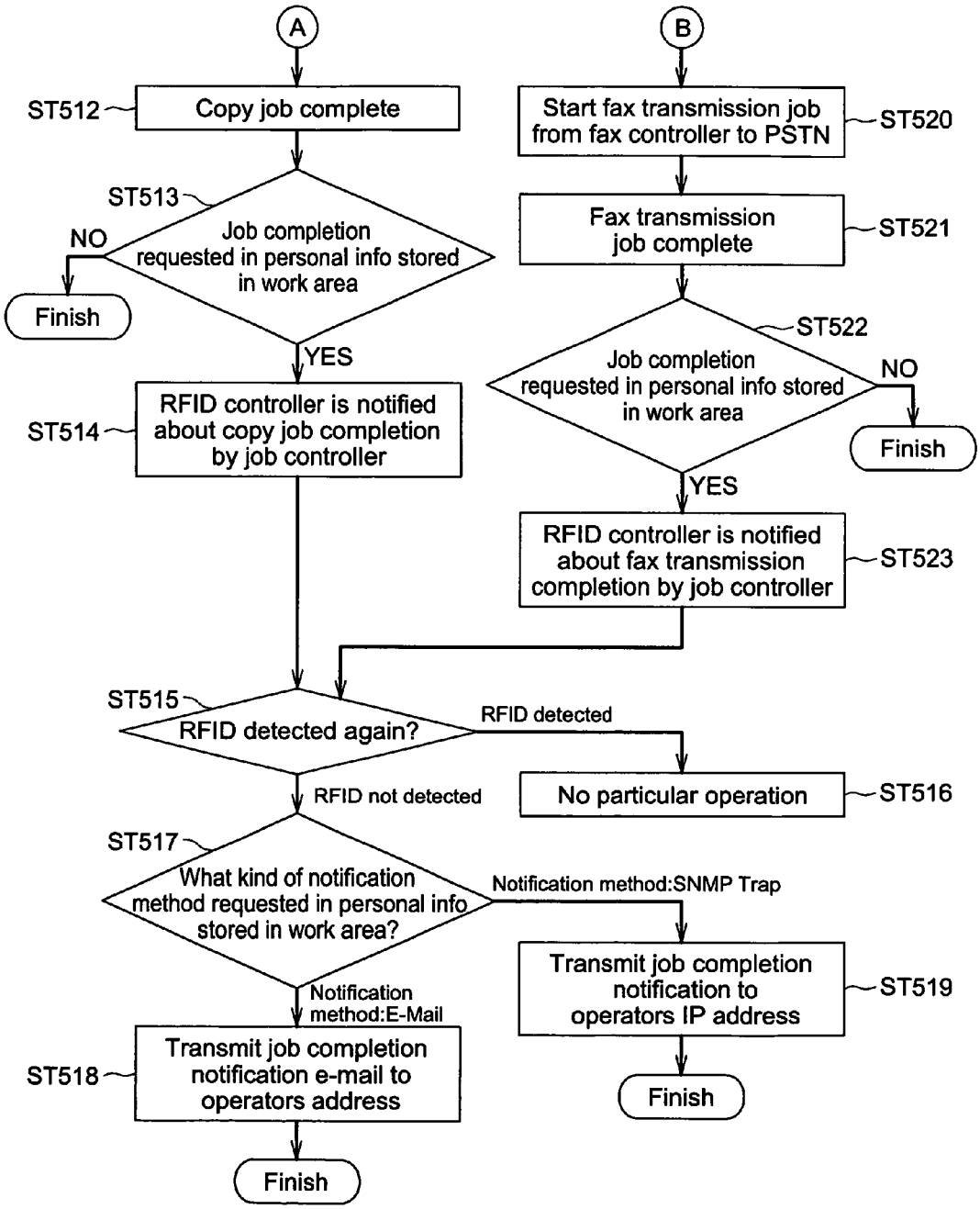
FIG. 6 is a second flowchart illustrating the operation of the multifunction apparatus according to the embodiment.

FIGS. 5 and 6 illustrate an operation of multifunction apparatus 100 according to the present embodiment.

For example, the user carrying memory card 200 stands in front of multifunction apparatus 100 to perform a desired operation.

RFID controller 117 of multifunction apparatus 100 detects that the user and memory card 200 have entered an electromagnetic signal detection area (ST 501). When the electromagnetic wave signal is reflected on memory card 200 (carried by the user), the registration information within memory card 200 is readout and stored in work area 121 (ST 502).

As shown in FIG. 3, memory card 200 includes user ID 301 of the user.

Accordingly, multifunction apparatus 100 automatically obtains the user ID of the user in the proximity. In other words, the user can have the user ID automatically input in multifunction apparatus 100 without any physical input.

Next, personal information controller 118 retrieves user ID 301 (personal identification information) from the registration information stored in work area 121 and notifies the same to personal information server I/F 120 (ST 503).

Personal information server I/F 120 transmits user ID 301 to personal information server 102 and issues a personal authentication request to personal information server 102 (ST 504), the request being made to check the existence of personal information table 400 that corresponds to user ID 301 (ST 504).

Upon receiving the personal authentication request for user ID 301 (from personal information server I/F 120), personal information server 102 uses user ID 301 to determine whether personal information table 400 corresponding to user ID 301 is registered (ST 505).

As shown in FIG. 4, each personal information table 400 includes a user ID 301. When personal information table 400 having the matching user ID 301 is registered, it is determined that personal information table 400 of the user is registered in personal information server 102.

When personal information table 400 corresponding to the transmitted user ID 301 is registered, personal information server 102, in response to the personal authentication request, transmits a response "registered user detection notification". When personal information table 400 is not registered, personal information server 102 transmits a response "non-registered user detection notification".

When personal information server I/F 120 receives the "non-registered user detection notification" response, personal information controller 118 of multifunction apparatus 100 gives the "non-registered user detection notification" response to panel controller 115 and performs a process to prohibit the use of the non-registered user.

Upon receiving the "non-registered user detection notification" response, panel controller 115 controls touch panel 114 to display a message indicating that the user is a non-registered user (ST 506).

Accordingly, multifunction apparatus 100 can prohibit the use of the apparatus by the non-registered user and displays an indication for the non-registered user that the user is a non-registered user. Therefore, multifunction apparatus 100 not only prevents the illegal use of the non-registered user but also encourages the non-registered user to register their information.

When personal information server I/F 120 receives the "registered user detection notification" response, personal information controller 118 uses personal information server I/F 120 to retrieve, from personal information server 102, the information of personal information table 400 corresponding to the transmitted user ID 301. Then, the information is stored in work area 121 (ST 507).

Next, job controller 122 of multifunction apparatus 100 detects need for job completion notification 402, method for job completion notification 403, and destination for job completion notification 404 from the information related to personal information table 400 stored in work area 121 (ST 508). This storage information is kept in its own internal memory so that the retrieval can be made easier at a later stage.

Next, job controller 122 transmits, to panel controller 115, a display instruction for menu screen on large-size touch panel 116, in order to enable selection and initiation of operations such as copying, facsimile transmission, printing, and scanning. Then, panel controller 115 displays the menu screen on large-size touch panel 116 (ST 509).

When the user selects a copy function from large-size touch panel 116 (ST 510), job controller 122 starts the operation for the copy job (ST 511).

When the copy job is completed (ST 512), job controller 122 starts the job completion notification process.

First, in order to check whether the user who instructed the copy job needs the job completion notification, job controller 122 refers to work area 121 and checks the need for job completion notification 402 from the personal information stored in work area 121 (ST 513).

Figure 7A:
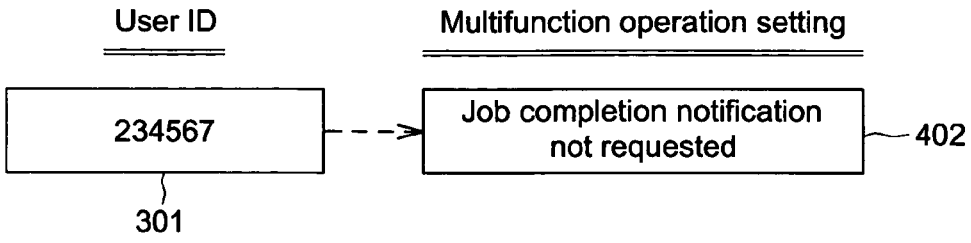
FIG. 7(*a*) is a first chart that illustrates personal information of the user according to the embodiment.
Figure 7B:
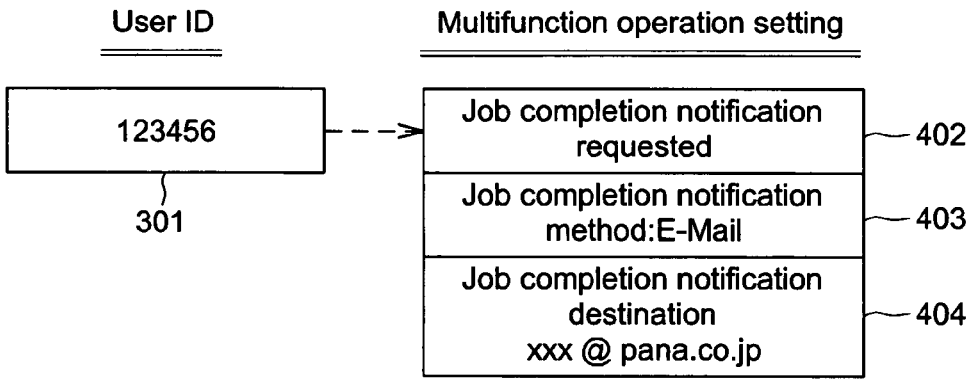
Figure 7C:
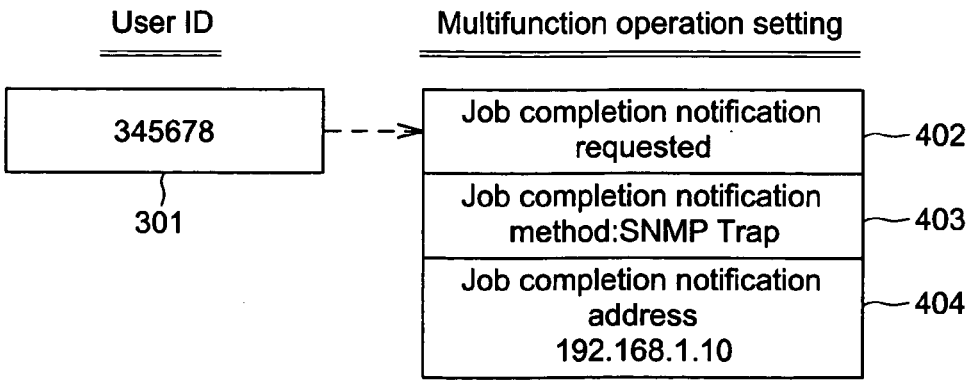

As shown in FIG. 7(*a*), when the job completion notification is not requested in the personal information of the user who instructed the copy job, job controller 122 completes the process because there is no need to perform the job completion notification.

Accordingly, the job completion notification is only transmitted to users who request the transmission of the job completion notification. Also, by checking the need for the completion notification, the destination and the method for job completion notification are obtained only when the completion notification is requested, thereby making the process more efficient.

As shown in FIGS. 7(*b*) and (*c*), when the job completion notification is requested in the personal information of the user who instructed the copy job, job controller 122 notifies RFID controller 117 of the completion of the copy job (ST 514). Then, RFID controller 117 re-detects memory card 200 of the user who performed the copy job (ST 515). By doing so, multifunction apparatus 100, using RFID controller 117, can determine whether the user is in the proximity.

When the copy job is relatively light, it is very likely that the user who performs the copy job is in the proximity of multifunction apparatus 100 until the job is completed and is able to see large-size touch panel 116. Therefore, there is no need for multifunction apparatus 100 to transmit the job completion message to the user, since the user can directly recognize the completion from multifunction apparatus 100.

When RFID controller 117 detects memory card 200 of the user (RFID detection) (ST 515), job controller 122 completes the process without any particular operation (ST 516).

Accordingly, when it is detected that user is in the proximity upon completion of the copy job, the user can directly recognize the job completion from multifunction apparatus 100 and is not at the destination of the job completion notification. Therefore, the job completion notification is not performed. Thus, unnecessary notifications are eliminated, thereby making the process more efficient.

When RFID controller 117 does not detect memory card 200 of the user (no RFID detection) (ST 515), it is necessary to transmit the job completion of notification because the user is not in the proximity. Therefore, job controller 122 checks method for job completion notification 403 from the personal information stored in work area 121 (ST 517).

As shown in FIG. 7(*b*), when method for job completion notification 403 is by e-mail, job controller 122 retrieves destination for job completion notification 404 in the personal information stored in work area 121 (in this case, e-mail address) and transmits the job completion notification to the retrieved e-mail address (ST 518).

As shown in FIG. 7(*c*), when method for job completion notification 403 is by SNMP Trap, job controller 122 retrieves destination of job completion notification 404 in the personal information stored in work area 121 (in this case, IP address) and transmits the job completion notification to the retrieved IP address (ST 519).

Multifunction apparatus 100 transmits the job completion notification as described above. At ST 515, the need for transmitting the job completion notification is checked again and the method and destination for the job completion notification are obtained only after the need is checked. Therefore, unnecessary information is not obtained, thereby making the process more efficient.

FIG. 8 illustrates the job completion notification related to the copy job. As shown in FIG. 8, job completion notification 800 includes job ID 801, job name 802, job type 803, job starting time 804, job ending time 805, number of pages 806, number of errors 807 (result of a job process), and job condition 808. Appropriate changes can be made to a job completion notification for a non-copy job.

Job completion notification 800 enables the user to check the job type and information such as whether the job is normally completed.

At ST 510, when the user selects a facsimile function from large-size touch panel 116, job controller 122 instructs facsimile controller 114 to initiate an operation for a facsimile transmission job (ST 519). Then, facsimile controller 114 starts the facsimile transmission job to the PSTN (ST 520).

Upon completing the facsimile transmission job (ST 521), facsimile controller 114 transmits, to job controller 122, the message indicating that the facsimile transmission job is completed. Then, job controller 122 initiates the job completion notification transmission process.

First, job controller 122 refers to work area 121 in order to check whether the user who instructed the facsimile transmission job needs the job completion notification and to check need for job completion notification 402 in the personal information stored in work area 121 (ST 522).

When the job completion notification is not requested in the personal information of the user who instructed the facsimile transmission job, job controller 122 completes the process because there is no need to perform the job completion notification.

When the job completion notification is requested in the personal information of the user who instructed the facsimile transmission job, job controller 122 notifies RFID controller 117 of the completion of the facsimile transmission job (ST 523). Then, RFID controller 117 performs the process described at ST 515.

Therefore, upon completing the facsimile transmission job, when it is detected that the user is still in the proximity, the job completion notification is not performed. Accordingly, unnecessary notifications are not performed, thereby making the process more efficient.

In addition, the process described after ST 515 is also performed for the facsimile transmission job. Therefore, the job completion notification is performed according to its need.

As described above, according to multifunction apparatus 100 of the present embodiment, when the user performs a copying or facsimile transmission job by directly setting the document on multifunction apparatus 100, multifunction apparatus 100 obtains user ID 301 from memory card 200 carried by the user. Further, multifunction apparatus 100 obtains destination 404 and method 403 for the job completion notification that are preset by user ID 301. Therefore, the job completion notification is transmitted to the desired destination 404 with the desired method 403.

Figure 9:
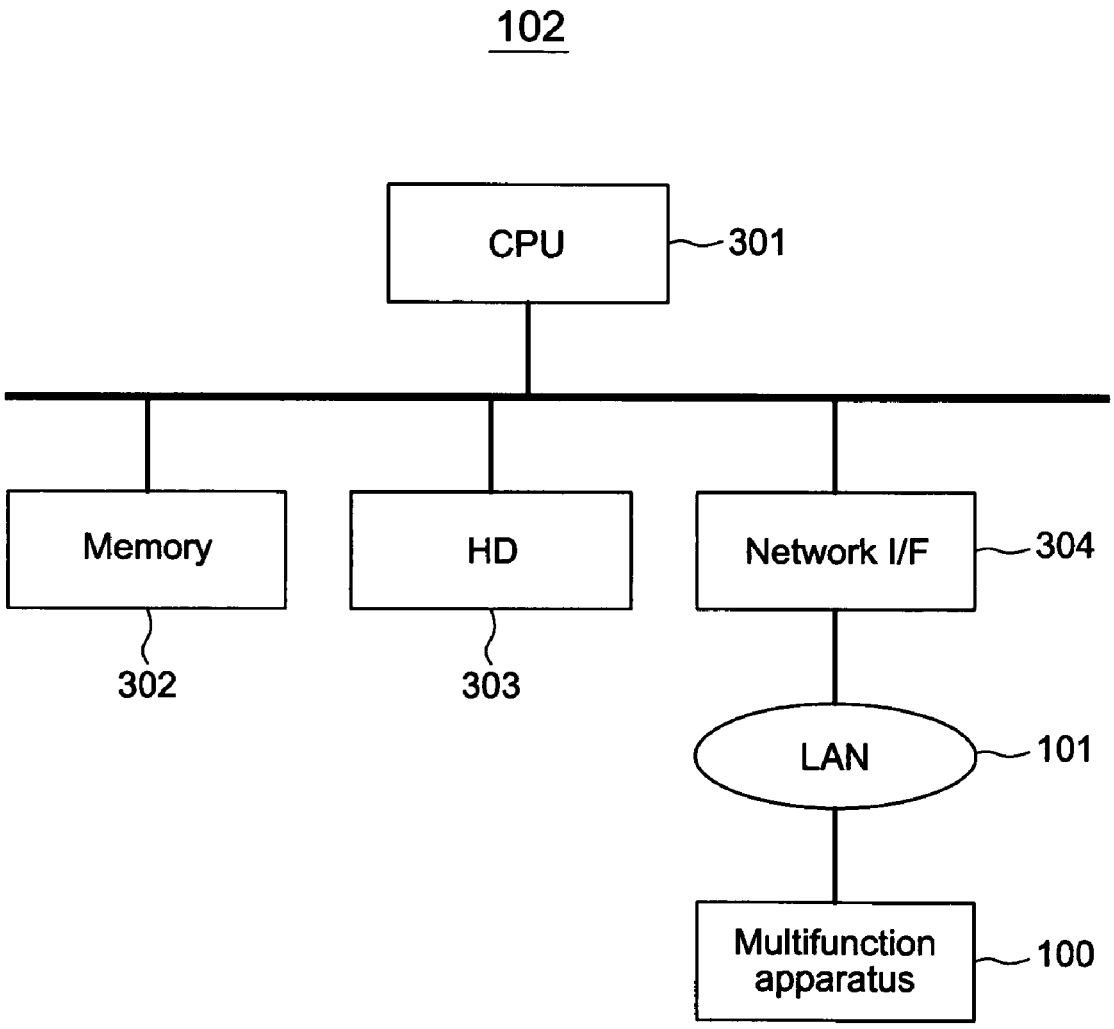
FIG. 9 is a block diagram illustrating a server according to the embodiment.

FIG. 9 is a functional block diagram of server 102 connected to multifunction apparatus 100, via LAN 101, according to the embodiment.

Server 102 shown in FIG. 9 includes CPU 301 that controls the entire apparatus. Memory 302 stores control programs to be used by CPU 301 for controlling the entire apparatus, and has a function to perform as work memory of CPU 301. Hard disk (HD) 303 stores information to be distributed to multifunction apparatus 100 according to the present embodiment. For example, when server 102 functions as a server for personal information, the personal information table is stored for each registered user. When server 102 functions as a web server, server 102 stores menus for multifunction apparatus 100 and related jobs. Network interface (I/F) 304 interfaces with LAN 101.

Figure 10:
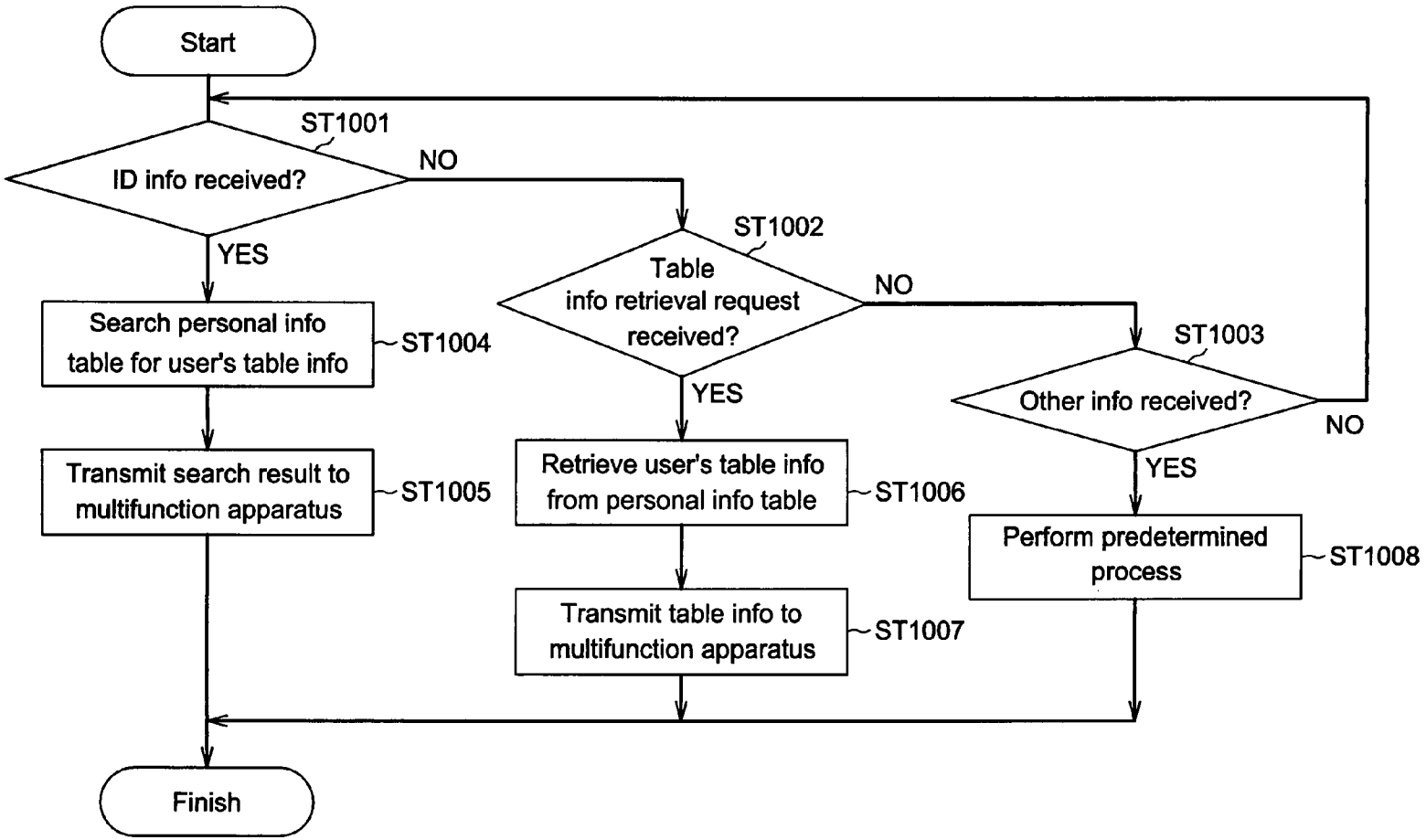
FIG. 10 is a flowchart illustrating an operation of the server according to the embodiment.

FIG. 10 illustrates a process of server 102 having the above-described configuration. In FIG. 10, in particular, server 102 functions as a personal authentication server.

Server 102 as a personal authentication server monitors, in an idle state, a reception of various information from multifunction apparatus 100 according to the present embodiment. In particular, server 102 monitors receptions of identification information (user ID) (ST 1001), request to retrieve table information (ST 1002), and other information (ST 1003).

When personal identification information is received at ST 1001, during the monitoring of receptions of various information, table information of the registered user is searched from personal information table 400 stored in HD 303 (ST 1004). Accordingly, it is determined whether the received identification information is registered in personal information table 400. Then, the result of the search (i.e., whether the identification information is registered) is transmitted to the accessing multifunction apparatus 100 (ST 1005). When the transmission process of the search result is completed, server 102 terminates the process.

When a request to retrieve information from personal information table 400 is received at ST 1002, table information of the registered user is retrieved from personal information tables 400 stored in HD 303 (ST 1006). Accordingly, personal information table 400 of the registered user (associated with the previously received identification information) is retrieved. Then, personal information table 400 is transmitted to the accessing multifunction apparatus 100 (ST 1007). When the transmission process of the table information is completed, server 102 terminates the process.

When other information is received at ST 1003, server 102 performs a process required for the information (ST 1008). When the required process is completed, server 102 terminates the process.

Server 102 is configured as described above. Server 102 performs user authentication, personal information transmission, and other operations using personal information table 400.

In the present embodiment, personal information server 120 stores personal information table 400 and separately manages the search on whether the user is registered (for user authentication) and destination for the job completion notification. However, personal information table 400 can be stored in multifunction apparatus 100 in advance, so that multifunction apparatus 100 can perform the user authentication and manage the destination for the job completion notification. With this system, there is no need to obtain the personal information from server 102, and multifunction apparatus 100 can perform the processes by itself.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Application No. 2004-051999 filed on Feb. 26, 2004, entire content of which is expressly incorporated by reference herein.

What is claimed is:

1. A multifunction apparatus having a plurality of functions including a copier function, the apparatus comprising:

an information retrieval unit that transmits an electromagnetic wave signal to a memory card carried by a user and retrieves identification information of the user, the user who has entered a detection area;

a memory that stores a destination for a job completion notification, the destination being preset by the user who is authenticated based on the identification information retrieved from the memory card; and a job controller that transmits a job completion notification to the destination stored in said memory, when a job is completed.

2. The multifunction apparatus according to claim 1, wherein said memory stores a notification method that is preset by the user, and wherein said job controller uses the notification method stored in said memory and transmits the job completion notification, when the job is completed.

3. The multifunction apparatus according to claim 1, wherein said memory stores information indicating a need for the completion notification, the information being preset by the user, and wherein said job controller transmits the job completion notification only when the completion notification is requested in the information obtained from said memory.

4. The multifunction apparatus according to claim 1, wherein said job controller does not perform the job completion notification when the identification information retrieved by said information retrieval unit upon completion of a job belongs to a user who generated the job.

5. The multifunction apparatus according to claim 1, wherein a personal information table is stored in a server, the server being connected via a network, the table registering personal information including user identification information and a destination for a job completion notification, and wherein a destination for a job completion notification of a user corresponding to identification information is retrieved from the server and stored in said memory, the identification information being retrieved from the memory card.

6. The multifunction apparatus according to claim 1, further comprising:

a memory apparatus that stores a personal information table, the table registering personal information including user identification information and a destination for a job completion notification, wherein a destination for a job completion notification of a user corresponding to identification information is retrieved from said memory apparatus and stored in said memory, the identification information being retrieved from the memory card.

7. A method for using a multifunction apparatus having a plurality of functions including a copier function, the multifunction apparatus having a memory that stores a destination for a job completion notification, the destination being preset by a user who is authenticated based on identification information retrieved from a memory card, the method comprising:

transmitting an electromagnetic wave signal to the memory card carried by a user;

retrieving identification information of the user, the user who has entered a detection area; and transmitting a job completion notification to the destination stored in the memory, when a job is completed.

8. The method according to claim 7, wherein the memory stores a notification method that is preset by the user, and wherein the transmitting a job completion notification uses the notification method stored in the memory and transmits the job completion notification, when the job is completed.

9. The method according to claim 7, wherein the memory stores information indicating a need for the completion notification, the information being preset by the user, and wherein the transmitting a job completion notification transmits the job completion notification only when the completion notification is requested in the information obtained from the memory.

10. The method according to claim 7, wherein the transmitting a job completion notification does not perform the job completion notification when the identification information which is being retrieved upon completion of a job belongs to a user who generated the job.

11. The method according to claim 7, wherein a personal information table is stored in a server, the server being connected via a network, the table registering personal information including user identification information and a destination for a job completion notification, and wherein a destination for a job completion notification of a user corresponding to identification information is retrieved from the server and stored in the memory, the identification information being retrieved from the memory card.

* * * * *